US005458467A

United States Patent [19]

Yuhasz

[11] Patent Number: 5,458,467

[45] Date of Patent: Oct. 17, 1995

[54] JET PUMP AND METHOD OF OPERATION THEREOF

[75] Inventor: Frank U. Yuhasz, Ashland, Ohio

[73] Assignee: McNeil (Ohio) Corporation, St. Paul, Minn.

[21] Appl. No.: 180,974

[22] Filed: Jan. 14, 1994

[51] Int. Cl.[6] ..... F04B 23/08

[52] U.S. Cl. ..... 417/83; 417/80; 417/84; 417/87; 417/88; 417/89

[58] Field of Search ..... 417/80, 83, 84, 417/87, 88, 89

[56] References Cited

U.S. PATENT DOCUMENTS

| | | | |
|---|---|---|---|
| 2,700,338 | 1/1955 | Smith | 417/83 |
| 2,810,346 | 10/1957 | Lung | 417/83 |
| 2,934,021 | 4/1960 | Conery et al. | 417/83 |
| 2,938,471 | 5/1960 | Jacuzzi et al. | 417/83 |
| 3,063,377 | 11/1962 | Stanley et al. | 417/83 |
| 3,291,051 | 12/1966 | Ekey | 417/83 |
| 4,627,792 | 12/1986 | Jensen et al. | 417/83 |
| 4,767,281 | 8/1988 | Sailer | 417/89 |
| 4,820,131 | 4/1989 | Johnson | 417/83 |

FOREIGN PATENT DOCUMENTS

| | | | |
|---|---|---|---|
| 0450308 | 8/1948 | Canada | 417/83 |

OTHER PUBLICATIONS

August 1990 Parts List and Exploded Views of Two Pumps (HJ & HD Series Ejecto Pumps) Manufactured by The F. E. Myers Division of Pentair, Inc., Ashland, Ohio.

A Portion of an engineering drawing showing the ⅓ HP pump of Reference 3 assembled; 1977.

A portion of an engineering drawing showing the ¾ HP pump of Reference 3 assembled; 1972.

*Primary Examiner*—Richard A. Bertsch

*Assistant Examiner*—Ted Kim

*Attorney, Agent, or Firm*—Renner, Kenner, Greive, Bobak, Taylor & Weber

[57] ABSTRACT

A pump (10) for providing water from a source to a remote location includes a casing (11) which receives the water through an inlet port (22) which is provided to the remote location through a discharge port (20). An impeller (30) in the casing (11) is rotated by a motor (23). A diffuser (35) is positioned adjacent to the impeller (30) and has a shoulder (42) facing the inlet port (22). A nozzle (44) is mounted in the inlet port (22) to receive low pressure water from the source which is transmitted to a venturi tube (43) positioned between the diffuser shoulder (42) and the front wall (16) of the casing (11). The venturi tube (43) directs water to the impeller (30) and diffuser (35) which provide water at high pressure, upon demand, through the discharge port (20) and also recirculates high pressure water in the casing (11) to the venturi tube (43) through openings (51) in the wall thereof.

11 Claims, 2 Drawing Sheets

JET PUMP AND METHOD OF OPERATION THEREOF

TECHNICAL FIELD

This invention relates to a jet or centrifugal pump which is adapted to provide water from a source to a remote location. More particularly, this invention relates to a unique nozzle/venturi assembly in a pump which is particularly suited to draw water from a shallow well and provide it to a home upon demand.

BACKGROUND ART

Pumps, commonly known as jet or centrifugal pumps, which provide water from a well to a home are, of course, known in the art. Such pumps include a pump casing having a suction inlet and discharge outlet, an impeller in the casing driven by a motor, and a diffuser, venturi and nozzle also in the casing. Typically, the venturi directly receives water supplied from the well through the suction inlet of the casing, and water at high pressure is recirculated from the impeller through the nozzle. The combined action of high velocity rotation of the impeller and high pressure recirculation of a fraction of its water output via the casing through the nozzle to the venturi produces a vacuum condition at the suction inlet of the casing. This allows atmospheric pressure to push water through the suction pipe from the bottom of the well to the casing suction inlet and feed water therefrom through the venturi tube to the impeller inlet and out through the discharge outlet.

These types of pumps, while operating satisfactorily to achieve the level of performance for which they were designed, are not without their problems. For example, such pumps usually require a large complicated casing which is difficult to cast and machine. Moreover, the assembly of the parts located in the casing is often difficult to accomplish, particularly to assure the proper location of certain components which is critical to the operation of the pump. For example, the distance between the nozzle and the venturi is critical and in some prior art designs, it was difficult to assure that every pump was assembled with the proper venturi/nozzle relationship.

Such is particularly true in those designs where low pressure water first enters the nozzle and passes through the venturi to the impeller from which the water is recirculated in the casing to the throat of the venturi in the small space between the venturi and the nozzle. In this instance the venturi is usually threaded onto the impeller and the spacing between the nozzle and the other end of the venturi is critical. However, in these situations manufacturing tolerances dictate that the distance between the other end of the venturi and the nozzle cannot always be the same thereby changing the performance of each pump being assembled. In addition, in such situations perfect threaded engagement and a perfectly round impeller hub was required. Otherwise, the venturi would wobble thereby providing inconsistent flow rates as the relationship between the venturi and the nozzle would constantly vary upon each rotation of the impeller.

In short, despite the popularity of the prior art designs, the need exists for a pump which is easy to manufacture and assemble and at the same time assure a constant relationship between the nozzle and the venturi so that every pump assembled will provide a constant flow rate and otherwise meet specifications.

DISCLOSURE OF THE INVENTION

It is thus an object of the present invention to provide a pump which is used primarily to provide water from a well to a home which can be more economically manufactured and assembled.

It is another object of the present invention to provide a pump, as above, in which the venturi is easily assembled therein to positively locate the venturi relative to the nozzle.

It is a further object of the present invention to provide a pump, as above, which will provide constant flow rates which will be uniform for all pumps manufactured according to the desired specifications.

These and other objects of the present invention, as well as the advantages thereof over existing prior art forms, which will become apparent from the description to follow, are accomplished by the improvements hereinafter described and claimed.

In general, a pump made in accordance with the concept of the present invention includes a casing having a water inlet port at one end thereof and a water discharge port. An impeller is positioned at the other end of the casing and is rotated by a motor. A diffuser is positioned adjacent to the impeller and may be provided with a shoulder facing the inlet port. A nozzle is mounted in the inlet port to receive incoming low pressure water therethrough from a water source. A venturi tube, which includes a generally cylindrical outer wall, can be positively positioned between the one end of the casing and the shoulder of the diffuser so as to receive water from the nozzle and provide it to the impeller. The impeller and diffuser, in turn, provide the water at high pressure, upon demand, through the discharge port and also recirculate a portion of the water at high pressure in the casing. Openings may be provided in the wall of the venturi tube at a location adjacent to the nozzle to receive the recirculating water.

The pump made in accordance with the present invention thus pumps water from a source to a remote location upon demand by transmitting water at low pressure from the source through the nozzle. The water is then transmitted from the nozzle to the venturi tube and from the venturi tube to the rotating impeller and water at high pressure is provided to the remote location. At least a portion of the high pressure water is recirculated back to the impeller by transmitting it through openings in the wall of the venturi tube.

A preferred exemplary pump which incorporates the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
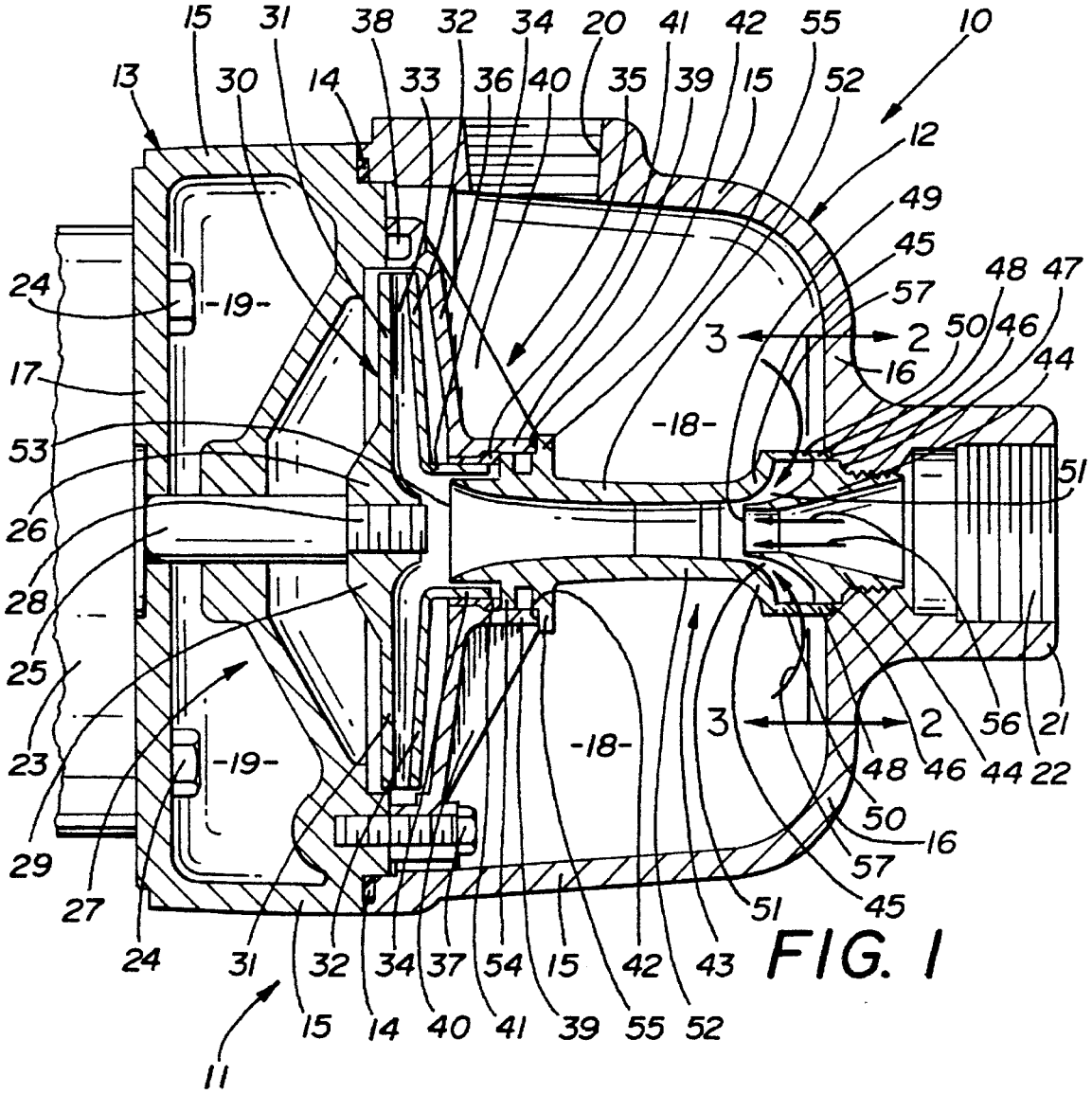
FIG. 1 is a fragmented sectional view taken along a longitudinal axis of a pump made in accordance with the concepts of the present invention.
Figure 2:
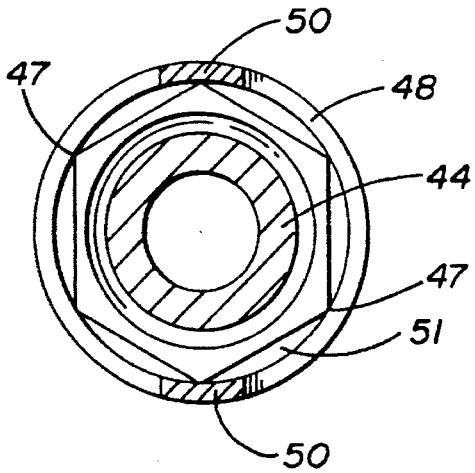
FIG. 2 is an enlarged sectional view taken substantially along line 2—2 of FIG. 1.
Figure 3:
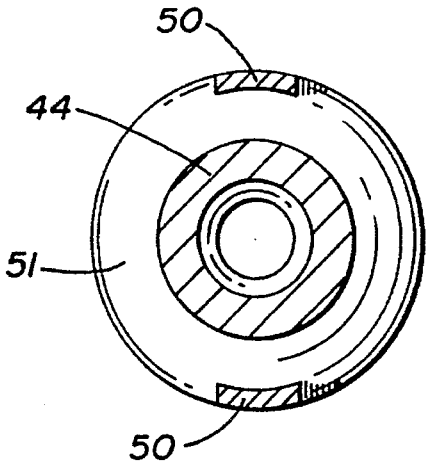
FIG. 3 is an enlarged sectional view taken substantially along line 3—3 of FIG. 1.

A pump made in accordance with the concepts of the present invention is indicated generally by the numeral 10 in FIG. 1 and includes a casing generally indicated by the numeral 11. Casing 11 is preferably made of cast iron, but, of course, could be made out of plastic, and is formed in two portions, a front portion generally indicated by the numeral 12 and a rear portion generally indicated by the numeral 13. As will hereinafter be described in more detail, casing portions 12 and 13 are attached by bolts (not shown) externally thereof to form casing 11. An O-ring seal 14 may be provided between casing portions 12 and 13. Once assembled, casing 11 includes a generally cylindrical sidewall 15 which merges with a front wall 16 of casing portion 12 and an opposed rear wall 17 of casing portion 13.

As will hereinafter become evident, a fluid flow cavity or chamber 18 is formed within casing portion 12 and a dead air space 19 is formed within casing portion 13. A discharge port 20 is formed in sidewall 15 of casing front portion 12 and communicates with chamber 18 to provide water to a remote location, such as a home or other building. Thus, port 20 is adapted to receive a pipe (not shown) or the like to provide a fluid flow line to the remote location.

A nipple 21 is formed on front wall 16 and defines a suction inlet port 22 which is adapted to communicate, as by piping or the like (not shown), with a source of water, such as a well. A power source, such as motor 23, can be attached, as by bolts 24, to rear wall 17 of casing 11. A motor shaft 25 extends from motor 23 through the hub 26 of a cup-shaped bracket formed with rear casing portion 13 and generally indicated by the numeral 27. Conventional shaft seals and the like (not shown) can be provided between shaft 25 and hub 26. Shaft 25 is threaded, as at 28, to the rear hub 29 of an impeller indicated generally by the numeral 30.

Impeller 30 is preferably made of a plastic material and is conventionally configured to include an annular rear plate 31 extending radially outwardly from hub 29, an annular front plate 32 opposed to rear plate 31, and a plurality of vanes (not shown for clarity) positioned between rear plate 31 and front plate 32 at the area indicated by the numeral 33. A generally cylindrical hollow hub 34 extends axially away from the inner periphery of front plate 32 toward a diffuser generally indicated by the numeral 35.

Like impeller 30, diffuser 35 is preferably made of a plastic material and is generally conventionally configured to include a generally annular body portion 36 adjacent to and generally encompassing impeller 30. The radial periphery of body portion 36 is attached to the outer periphery of bracket 27 at a plurality of locations, as by screws 37 (one shown). Diffuser 35 also includes a plurality of vanes (not shown for clarity) positioned at the area indicated by the numeral 38. As is well known in the art and as will be described further herein, the vanes of diffuser 35 receive the water at the high velocity energy created by the vanes of impeller 30 and convert it to high pressure energy.

Diffuser 35 also includes a central hollow cylindrical hub 39 positioned at the radially inner end of body portion 36. A plurality of stiffening ribs 40 may extend along body portion 36 to the radially outer side of hub 39 to provide extra strength thereto. Hub 34 of impeller 30 is closely received within diffuser hub 39 and a wear ring 41, preferably made of stainless steel or other metallic material, may be provided on the internal portion of hub 39 adjacent hub 34 to assure a close fit therebetween. As will hereinafter be described in more detail, the axially inner end of diffuser hub 39 facing inlet port 22 forms a shoulder 42 upon which a venturi tube, generally indicated by the numeral 43, rests.

Figure 4:
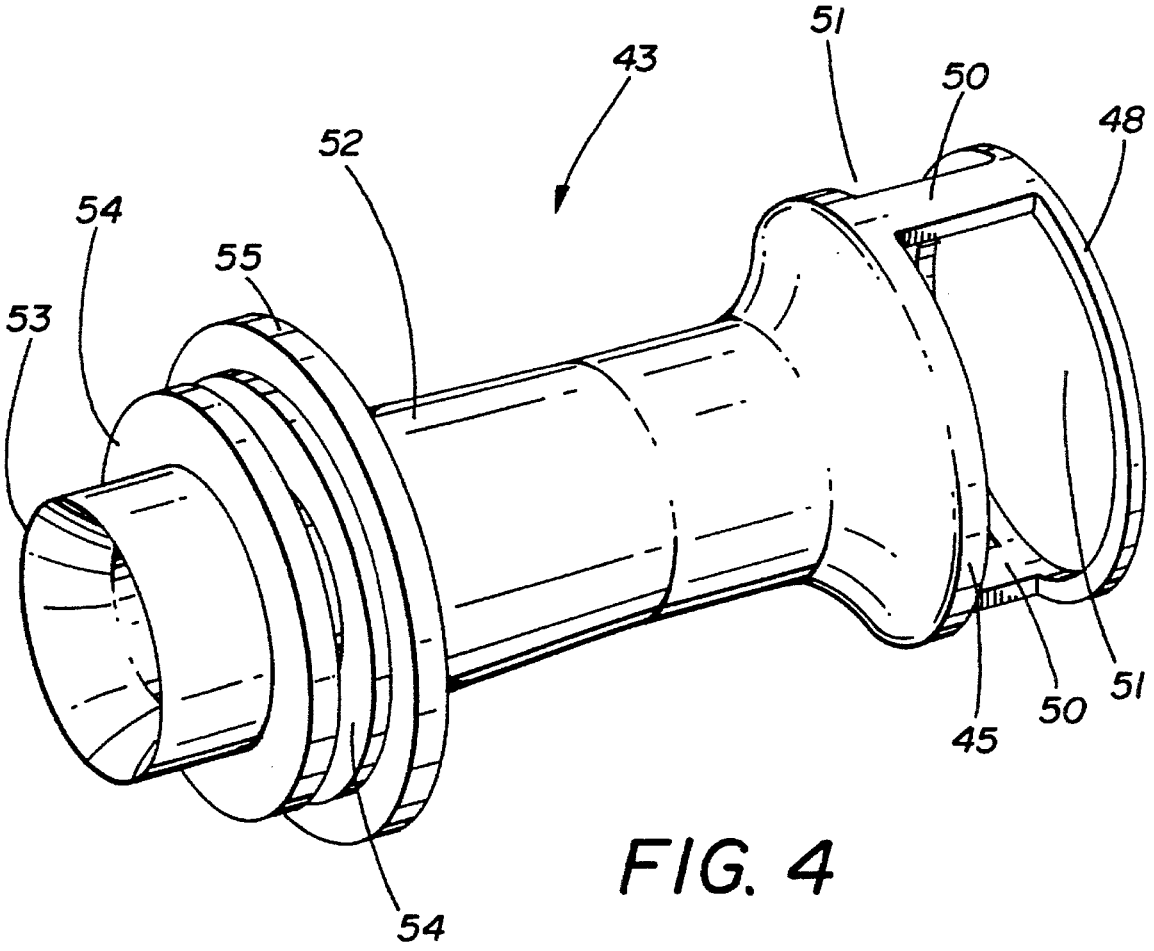
FIG. 4 is an enlarged perspective view of the venturi tube utilized in conjunction with the pump made in accordance with the concepts of the present invention.

A nozzle 44 is threaded into inlet port 22 so that water from the remote source can pass therethrough to the throat 45 of venturi tube 43. Venturi tube 43 is best shown in FIG. 4 and is generally cylindrical in its overall configuration and is positioned between front wall 16 of casing 11 and shoulder 42 of diffuser 35. To that end, a generally circular recess or notch 46 is formed in the inside of front wall 16 around the hex edges 47 of nozzle 44. Notch 46 receives a circular end ring 48 of venturi tube 43, which is thereby received around the hex edges 47 of nozzle 44, and when the bolts (not shown) are tightened to attach casing portion 12 to casing portion 13, venturi tube 43 is positively positioned within casing 11 between diffuser shoulder 42 and casing front wall 16. As such, throat 45 is positively positioned relative to the inner tip 49 of nozzle 44 in a very close and precise relationship for proper fluid flow by rib members 50 which extend from ring 48 rearwardly to throat 45. However, rib members 50 only traverse a small arcuate portion of the circumference of the cylindrical wall of venturi tube 43 thereby creating openings 51 in the wall of venturi tube 43 between ring 48 and throat 45 and adjacent to nozzle 44.

Venturi tube 43 extends inwardly from throat 45 with its main body portion 52 having an inner end 53 received within impeller hub 34. As most clearly shown in FIG. 4, spaced annular guide rings 54 may be formed on the outside of body portion 52 and are of a diameter slightly less than the inner diameter of diffuser hub 39 to assure positive radial positioning of venturi tube 43. Axial positioning of venturi tube 43 is assured in view of an annular collar 55 formed on venturi body portion 52. Collar 55 is axially positioned at the precise location on body portion 52 so that, as described hereinabove, when casing 11 is assembled, collar 55 abuts diffuser shoulder 42. In effect then, venturi tube 43 is sandwiched between shoulder 42 and front wall 16 of casing 11 with the proper spacing between nozzle 44 and venturi throat 45, as well as the proper spacing between the inner end 53 of venturi tube 43 and impeller 30, being assured. As such, every pump assembled will uniformly have the same flow rate according to desired specifications.

In operation, upon demand, water is drawn in through nozzle 44 at a low pressure, for example, atmospheric pressure, as shown by arrows 56 in FIG. 1, and is provided at a constant flow rate directly into venturi tube 43 to impeller 30. The energy of the high velocity water created by this assembly is converted by diffuser 35 to a high pressure energy, for example, twenty psi, and the water may be discharged through port 20. A portion of the high pressure water is recirculated through openings 51 in venturi tube 43, as shown by arrows 57 in FIG. 1, passing between tip 49 of nozzle 44 and venturi throat 45, and is then transferred back to impeller 30. When demand ceases, motor 23 will continue to rotate impeller 30 to increase the pressure in chamber 18 even higher to, for example, forty psi, at which time a pressure switch (not shown) will turn motor 23 off. Of course, while motor 23 is still running, this high pressure water is continually recirculating through openings 51 in venturi tube 43 but is not being discharged through port 20. However, upon the next demand, the recirculating water will be provided through port 20 until a reduced high pressure, for example, twenty psi, is sensed by the pressure switch which will then activate motor 23 and low pressure water will again be drawn in through nozzle 44 as the cycle repeats.

It should thus be evident that a pump constructed in accordance with the concepts of the present invention, as described above, accomplishes the objects of the present invention and otherwise substantially improves the art.

I claim:

1. A pump comprising a casing having a water inlet port at one end and a water discharge port, a motor, an impeller in said casing at the other end of said casing, said impeller being rotated by said motor, a diffuser adjacent said impeller and having a shoulder facing said inlet port, a nozzle mounted in said casing at said inlet port to receive incoming low pressure water therethrough, a venturi tube having one end abutting said one end of said casing and having a collar entending outwardly from its other end to abut said shoulder of said diffuser, said venturi tube receiving water from said nozzle and providing water to said impeller, said impeller and diffuser providing, upon demand, water through said discharge port and also recirculating a portion of the water at high pressure in said casing to said venturi tube.

2. A pump according to claim 1, said venturi tube having a generally cylindrical wall, and further comprising openings in said wall adjacent to said nozzle so that said venturi tube receives the recirculating water through said openings.

3. A pump according to claim 2 wherein said generally cylindrical wall includes a ring member at said one end of said venturi, said ring member being the portion of said venturi abutting said one end of said casing, a venturi throat, and rib members extending from said ring member to said throat, said openings being formed between said ring member, said throat and said rib members.

4. A pump according to claim 1 wherein said diffuser includes a hollow generally cylindrical hub and further comprising guide means on said venturi tube received within said hub of said diffuser.

5. A pump comprising a casing having a water inlet port at one end and a water discharge port, a motor, an impeller in said casing at the other end of said casing, said impeller being rotated by said motor and having a hollow generally cylindrical hub., a diffuser adjacent said impeller and having a shoulder facing said inlet port, said diffuser including a hollow generally cylindrical hub, said cylindrical hub of said impeller being positioned within said diffuser hub, a nozzle mounted in said casing at said inlet port to receive incoming low pressure water therethrough, a venturi tube positioned between said one end of said casing and said shoulder of said diffuser, guide means on said venturi tube received within said hub of said diffuser such that an end of said venturi tube is received within said impeller hub, said venturi tube receiving water from said nozzle and providing water to said impeller, said impeller and diffuser providing, upon demand, water through said discharge port and also recirculating a portion of the water at high pressure in said casing to said venturi tube.

6. A pump according to claim 5 further comprising a wear ring positioned between said impeller hub and said diffuser hub.

7. A pump comprising a casing having a water inlet port at one end and a water discharge port, a motor, an impeller in said casing at the other end of said casing, said impeller being rotated by said motor, a diffuser adjacent said impeller, said diffuser having a shoulder facing said inlet port, a nozzle mounted in said casing at said inlet port to receive incoming low pressure water therethrough, a venturi tube having a generally cylindrical wall, a collar extending outwardly from said wall of said venturi tube, said collar abutting said shoulder, said wall having a ring member abutting said one end of said casing so that said venturi tube is positioned between said one end of said casing and said shoulder of said diffuser, said wall also including a venturi throat and rib members extending from said ring member to said throat, said venturi tube receiving water from said nozzle and providing water to said impeller, said impeller and diffuser providing, upon demand, water through said discharge port and also recirculating a portion of the water at high pressure in said casing, and openings formed between said ring member, said throat and said rib members in said wall of said venturi tube adjacent to said nozzle so that said venturi tube receives the recirculating water.

8. A pump comprising a casing having a water inlet port at one end and a water discharge port, a motor, an impeller in said casing at the other end of said casing, said impeller being rotated by said motor, a diffuser adjacent said impeller, said diffuser including a hollow generally cylindrical hub, a nozzle mounted in said casing at said inlet port to receive incoming low pressure water therethrough, a venturi tube having a generally cylindrical wall, guide means on said venturi tube received within said hub of said diffuser, said venturi tube receiving water from said nozzle and providing water to said impeller, said impeller and diffuser providing, upon demand, water through said discharge port and also recirculating a portion of the water at high pressure in said casing, and openings in said wall of said venturi tube adjacent to said nozzle so that said venturi tube receives the recirculating water.

9. A pump according to claim 8 wherein said impeller includes a hollow generally cylindrical hub positioned within said diffuser hub, an end of said venturi tube being received within said impeller hub.

10. A pump according to claim 9 further comprising a wear ring positioned between said impeller hub and said diffuser hub.

11. A method of pumping water from a source to a remote location upon demand comprising the steps of positioning a venturi tube in a casing having two portions by the step of connecting the two portions of the casing, transmitting water at low pressure from the source to the casing through a nozzle, transmitting the water from the nozzle through the venturi tube, transmitting the water from the venturi tube to a rotating impeller and a diffuser thereby providing water at high pressure to the remote location upon demand, and recirculating at least a portion of the high pressure water to the impeller by transmitting the high pressure water through openings in the wall of the venturi tube.

* * * * *